US011662758B2

(12) United States Patent
Enam et al.

(10) Patent No.: US 11,662,758 B2
(45) Date of Patent: May 30, 2023

(54) VOLTAGE REGULATOR CIRCUIT FOR FOLLOWING A VOLTAGE SOURCE WITH OFFSET CONTROL CIRCUIT

(71) Applicant: KYOCERA AVX Components (San Diego), Inc., San Diego, CA (US)

(72) Inventors: Syed Khursheed Enam, Lake Forest, CA (US); Amin Shameli, Irvine, CA (US); Mansoorali Companywala, Rancho Santa Margarita, CA (US); Jesse Shih-Chieh Hsin, San Diego, CA (US)

(73) Assignee: KYOCERA AVX Components (San Diego), Inc., San Diego, CA (US)

( * ) Notice: Subject to any disclaimer, the term of this patent is extended or adjusted under 35 U.S.C. 154(b) by 0 days.

(21) Appl. No.: 17/733,339

(22) Filed: Apr. 29, 2022

(65) Prior Publication Data

US 2022/0253084 A1 Aug. 11, 2022

Related U.S. Application Data

(63) Continuation of application No. 16/811,041, filed on Mar. 6, 2020, now abandoned.

(60) Provisional application No. 62/819,136, filed on Mar. 15, 2019.

(51) Int. Cl.
*G05F 1/575* (2006.01)

(52) U.S. Cl.
CPC ..... *G05F 1/575* (2013.01)

(58) Field of Classification Search
CPC ..... G05F 1/575; G05F 1/565
See application file for complete search history.

(56) References Cited

U.S. PATENT DOCUMENTS

| | | | | |
|---|---|---|---|---|
| 6,188,211 | B1 * | 2/2001 | Rincon-Mora | G05F 1/575 323/273 |
| 6,765,536 | B2 | 7/2004 | Phillips et al. | |
| 6,987,493 | B2 | 1/2006 | Chen | |
| 7,068,234 | B2 | 6/2006 | Sievenpiper | |
| 7,215,289 | B2 | 5/2007 | Harano | |
| 7,830,320 | B2 | 11/2010 | Shamblin | |
| 7,911,402 | B2 | 3/2011 | Rowson et al. | |
| 8,362,962 | B2 | 1/2013 | Rowson et al. | |
| 8,446,318 | B2 | 5/2013 | Ali et al. | |
| 8,648,755 | B2 | 2/2014 | Rowson et al. | |
| 8,717,241 | B2 | 5/2014 | Shamblin et al. | |

(Continued)

*Primary Examiner* — Jue Zhang
*Assistant Examiner* — Jye-June Lee
(74) *Attorney, Agent, or Firm* — Dority & Manning, P.A.

(57) ABSTRACT

A voltage regulator can include an input device, a current mirror, one or more offset control circuits, an output device, and a positive feedback loop. The input device can be configured to receive a source voltage from a voltage source. The current mirror can be coupled to the input device and configured to provide load current regulation within the voltage regulator. The one or more offset control circuits can be configured to balance voltage levels within the voltage regulator. The output device can include at least a first transistor that is matched to a second transistor within the voltage regulator such that the matching is configured to provide supply regulation within the voltage regulator. The positive feedback loop can be formed at least in part by the current mirror, the first transistor and the second transistor.

17 Claims, 3 Drawing Sheets

(56) References Cited

U.S. PATENT DOCUMENTS

| | | | | |
|---|---|---|---|---|
| 9,065,496 | B2 | 6/2015 | Rowson et al. | |
| 9,231,669 | B2 | 1/2016 | Desclos et al. | |
| 9,240,634 | B2 | 1/2016 | Rowson et al. | |
| 9,425,497 | B2 | 8/2016 | Pajona et al. | |
| 9,439,151 | B2 | 9/2016 | Zhu et al. | |
| 9,479,242 | B2 | 10/2016 | Desclos et al. | |
| 9,590,703 | B2 | 3/2017 | Desclos et al. | |
| 9,755,305 | B2 | 9/2017 | Desclos et al. | |
| 9,755,580 | B2 | 9/2017 | Desclos et al. | |
| 2005/0253645 | A1* | 11/2005 | North | G05F 3/267 327/543 |
| 2014/0247035 | A1* | 9/2014 | Gupta | G05F 3/262 323/315 |

* cited by examiner

VOLTAGE REGULATOR CIRCUIT FOR FOLLOWING A VOLTAGE SOURCE WITH OFFSET CONTROL CIRCUIT

PRIORITY CLAIM

The present application is a continuation of U.S. application Ser. No. 16/811,041 filed on Mar. 6, 2020, titled "Voltage Regulator Circuit For Following A Voltage Source With Offset Control Circuit," which claims the benefit of priority of U.S. Provisional App. No. 62/819,136, titled "Voltage Regulator Circuit For Following A Voltage Source," having a filing date of Mar. 15, 2019, which is incorporated by reference herein.

FIELD

Example aspects of the present disclosure generally relate to the field of voltage regulation for electronic circuits, for instance, to a voltage regulator circuit configured for coupling to and following of a voltage source.

BACKGROUND

Electronic circuit applications have conventionally used various types of voltage regulators to maintain the voltage of a power source within acceptable limits. By keeping voltages within a prescribed range, voltage regulators can help to ensure operational effectiveness and safety tolerances for coupled circuits or other electrical equipment using the source voltage.

One example form of known voltage regulator is a Low Drop Out (LDO) voltage regulator. An LDO voltage regulator is a type of linear voltage regulator that is used to provide supply power to multiple circuit blocks to isolate noise coupling from one block to another. However, the voltage output of an LDO for one block cannot follow the supply voltage of the block generating the input signal. This can cause threshold mismatch at input due to supply mismatch.

SUMMARY

Aspects and advantages of embodiments of the present disclosure will be set forth in part in the following description, or may be learned from the description, or may be learned through practice of the embodiments.

One example aspect of the present disclosure is directed to a voltage regulator comprising an input device, a current mirror, one or more offset control circuits, an output device, and a positive feedback loop. The input device is configured to receive a source voltage from a voltage source. The current mirror is coupled to the input device and configured to provide load current regulation within the voltage regulator. The one or more offset control circuits are configured to balance voltage levels within the voltage regulator. The output device includes at least a first transistor that is matched to a second transistor within the voltage regulator such that the matching is configured to provide supply regulation within the voltage regulator. The positive feedback loop is formed at least in part by the current mirror, the first transistor and the second transistor.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

Figure 1:
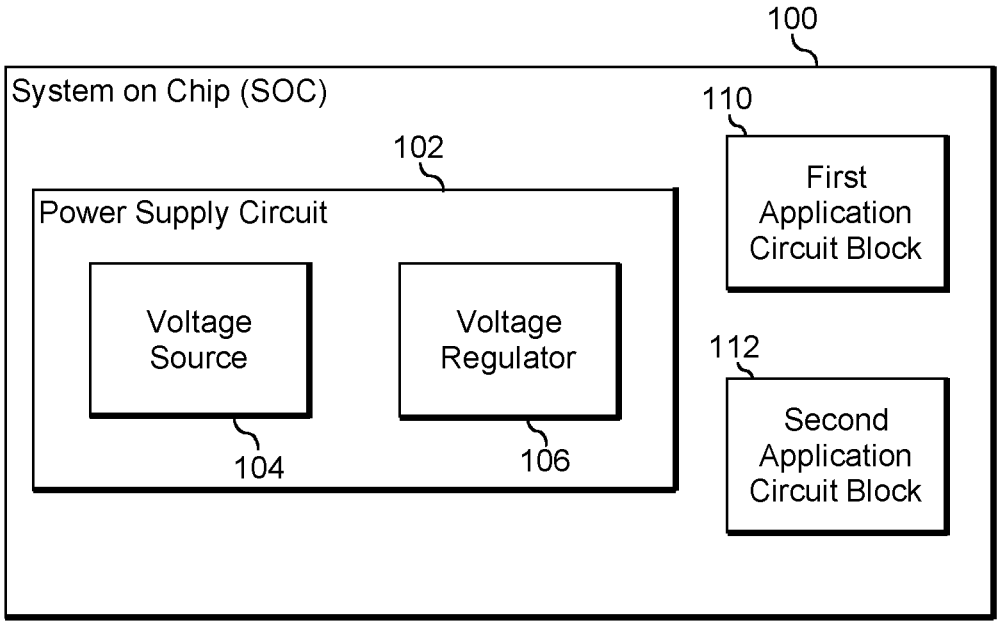
FIG. 1 illustrates a block diagram of an example embodiment of system on a chip (SOC) according to example embodiments of the present disclosure.

Repeat use of reference characters in the present specification and drawings is intended to represent same or analogous features or elements of the invention.

DETAILED DESCRIPTION

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to a voltage regulator circuit for coupling to a voltage source and providing a regulated power supply for one or more application circuit blocks in an integrated circuit. A voltage regulator circuit can include, for example, an input device, a current mirror, one or more offset control circuits, an output device, and a positive feedback loop. These circuit components and others work together to provide an effective method of isolating supply noise yet avoiding threshold mismatch at input due to supply mismatch. As such, a voltage regulator can be provided that automatically compensates for the input supply variation and load current variation at the same time without any stability issues. In addition, the voltage regulator can advantageously include one or more control mechanisms which can introduce intentional mismatch in supply to improve signal detection.

More particularly, a voltage regulator circuit can include an input device and an output device. The input device can include one or more electric circuit elements, integrated circuits, or nodes configured to receive a source voltage from a voltage source. In some examples, the input device includes a combination of one or more transistors. In some examples, one or more features forming the input device also contribute to forming a current mirror. Such a current mirror can be part of and/or can be coupled to the input device and configured to provide load current regulation within the voltage regulator circuit.

In accordance with another aspect of the disclosed technology, in some embodiments, a voltage regulator circuit can include one or more offset control circuits configured to balance voltage levels within the voltage regulator circuit. In some embodiments, each offset control circuit can include one or more resistors and at least one programmable current source. For instance, a voltage regulator circuit can include a positive offset control circuit configured to implement a positive shift of a first voltage level within the voltage regulator circuit. In some embodiments, the positive offset control circuit can include at least a first resistor and a first programmable current source. Additionally or alternatively, the voltage regulator circuit can include a negative offset control circuit configured to implement a negative shift of a second voltage level within the voltage regulator circuit. In some embodiments, the negative offset control circuit can include at least a second resistor and a second programmable current source.

In accordance with another aspect of the disclosed technology, in some embodiments, an output device can include one or more electric circuit elements, integrated circuits, or nodes configured to provide a regulated output voltage to one or more other circuit blocks. For example, an output device can include at least a first transistor that is matched to a second transistor within the voltage regulator circuit such that the matching between first and second transistors is configured to provide supply regulation within the voltage regulator circuit. As such, a supply regulator is implemented in part from matching between a transistor (e.g., the first transistor forming the output device) and a second transistor elsewhere in the voltage regulator circuit. In some examples, the first and second transistors that form such a supply regulator correspond to field effect transistors, for example n-type MOSFET devices.

In accordance with another aspect of the disclosed technology, a voltage regulator circuit in accordance with the disclosed technology can include a positive feedback loop. A positive feedback loop can be formed at least in part by a current mirror, the first transistor forming the output device, and the second transistor formed to provide matching with the first transistor. In some implementations, the voltage regulator circuit includes at least a third transistor and a fourth transistor (e.g., as part of the current mirror) such that the positive feedback loop is formed at least in part by the first transistor, the second transistor, the third transistor, and the fourth transistor. In some implementations, the first transistor and the second transistor comprise n-channel transistors, while the third transistor and the fourth transistor comprise p-channel transistors. In some implementations, each of the first transistor, the second transistor, the third transistor, and the fourth transistor comprise field effect transistors (e.g., MOSFETs). In some implementations, the positive feedback loop is characterized by a loop gain that is less than one under all conditions encountered within the voltage regulator circuit.

According to another aspect of the present disclosure, the voltage regulator circuit can include a current regulator. In some implementations, the current regulator can include a plurality of transistors (e.g., MOSFETs such as a combination of n-channel transistors and p-channel transistors). In some implementations, the current regulator can be configured to guarantee that the current pulled from the source voltage is always greater than the current forced into the voltage source by the second transistor.

Voltage regulator systems and methods in accordance with the disclosed technology offer many technical effects and benefits. For example, a voltage regulator circuit as disclosed herein can advantageously provide a continuously controlled, steady, low-noise DC output voltage. Similar to LDOs, the disclosed voltage regulator circuits work well even when the output voltage is very close to the input voltage, improving its power efficiency. In addition, the disclosed voltage regulator circuit can help to provide a very low-noise voltage source, even in the presence of noise on the incoming power supply or transients in the load. In addition, by providing features to automatically compensate for input supply variation and load current variation, potential supply noise can be advantageously isolated. In addition, a voltage regulator circuit can simultaneously avoid threshold mismatch at input due to supply mismatch.

FIG. 1 illustrates a block diagram of an example embodiment of a system on a chip (SOC) according to example embodiments of the present disclosure. More particularly, a system on a chip (SOC) 100 can correspond to an integrated circuit that incorporates multiple circuit blocks together in a single physical structure. In some embodiments, SOC 100 is an integrated circuit that includes a power supply 102, a first application circuit block 110, and a second application circuit block 112. The power supply circuit 102 can provide a regulated power source to multiple circuit blocks in accordance with the disclosed technology. In one example, one or more of the first application circuit block 110 and second application circuit block 112 includes an antenna (e.g., an active antenna) that is configured to functionally operate via a regulated output voltage from power supply circuit 102.

Although the example of FIG. 1 depicts a first application circuit block 110 and a second application circuit block 112, it should be appreciated that power supply circuit 102 can provide a regulated power source to a fewer number of circuit blocks (e.g., a single circuit block) or a greater number of circuit blocks (e.g., three or more circuit blocks) in accordance with different embodiments.

Power supply circuit 102 can generally include a voltage source 104 and a voltage regulator 106. Voltage source 104 can be configured to provide a source voltage, while voltage regulator 106 can be configured to receive the source voltage from the voltage source 104. By including voltage regulator 106 along with voltage source 104, power supply circuit 102 can effectively provide features for isolating supply noise while simultaneously avoiding threshold mismatch at input due to supply mismatch. More particularly, power supply circuit 102 can automatically compensate for input supply variation (e.g., variation in source voltage levels from voltage source 104) and load current variation (e.g., variation in load current introduced by first application circuit block 110 and/or second application circuit block 112) at the same time without any stability issues.

Although not depicted in FIG. 1, some implementations of a power supply circuit 102 can include an additional form of voltage regulator (e.g., a low drop out (LDO) voltage regulator) in addition to voltage regulator 106. For example, a source voltage from voltage source 104 can be supplied to voltage regulator 106 via an LDO voltage regulator provided in between voltage source 104 and voltage regulator 106. An output of such an LDO voltage regulator can be provided as an input voltage ($V_{IN}$) to voltage regulator 106.

It should be appreciated that one or more aspects of the voltage regulator 106 and/or power supply circuit 102 can be provided separately from the environment in which they are depicted in FIG. 1 (e.g., within an SOC environment). More particular details regarding exemplary embodiments of a voltage regulator 106 are depicted in FIGS. 2-3.

Figure 2:
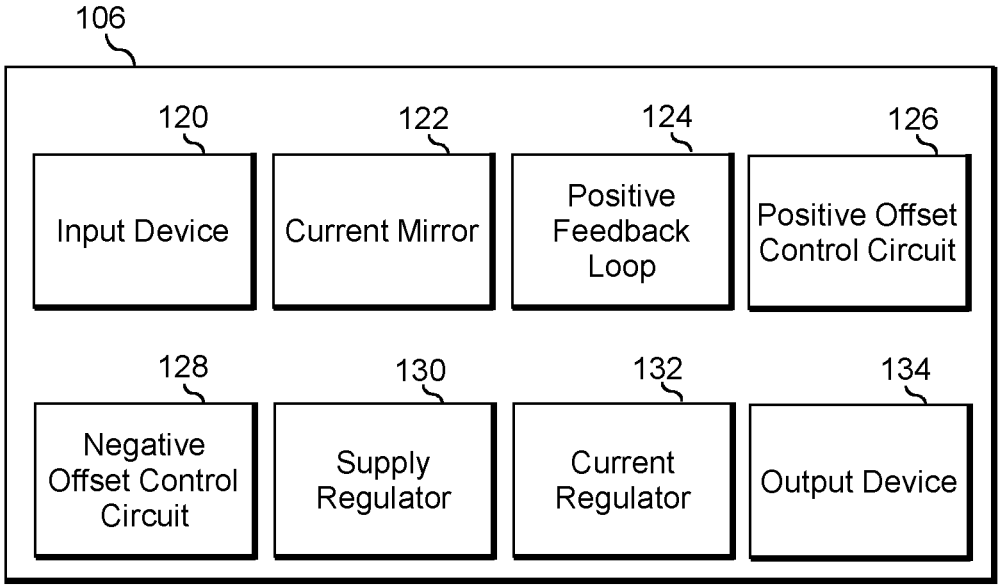
FIG. 2 illustrates a block diagram of an example voltage regulator according to example embodiments of the present disclosure.
Figure 3:
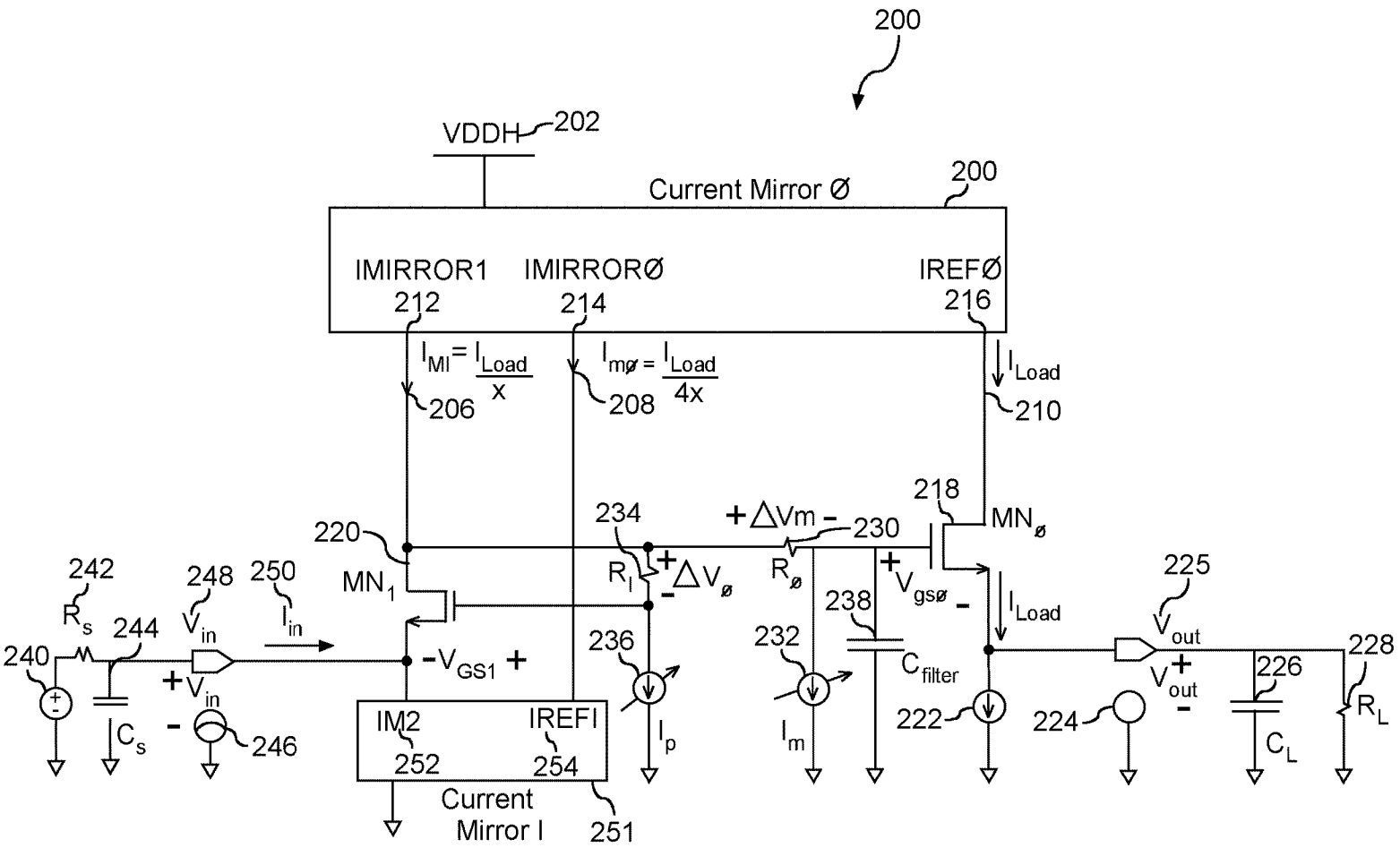
FIG. 3 illustrates a schematic diagram of an example voltage regulator circuit according to example embodiments of the present disclosure.

FIG. 2 illustrates a block diagram of an example voltage regulator according to example embodiments of the present disclosure. More particularly, voltage regulator 106 can include an input device 120, a current mirror 122, a positive feedback loop 124, one or more offset control circuits (e.g., a positive offset control circuit 126 and/or a negative offset control circuit 128), a supply regulator 130, a current regulator 132, and an output device 134. Although the various components of voltage regulator 106 in FIG. 2 are depicted as distinct blocks, it should be appreciated that circuit elements used to implement each of the components in FIG. 2 may not necessarily be distinct. More particularly, one or more particular circuit components within voltage regulator 106 can be used as part of more than one depicted component. For instance, a circuit element forming input device 120 can also form a part of current mirror 122, as will be appreciated from the example of FIG. 3.

Referring still to FIG. 2, voltage regulator 106 can include an input device 120. Input device 120 can include one or more electric circuit elements, integrated circuits, or nodes configured to receive a source voltage from a voltage source (e.g., voltage source 104 of FIG. 1). In some examples, input device 120 includes a combination of one or more transistors. In some examples, one or more features forming input device 120 also contribute to forming current mirror 122. Current mirror 122 can be part of and/or can be coupled to input device 120 and configured to provide load current regulation within voltage regulator 106.

In accordance with another aspect of the disclosed technology, in some embodiments, voltage regulator 106 can include one or more offset control circuits configured to balance voltage levels within the voltage regulator 106. In some embodiments, each offset control circuit can include one or more resistors and at least one programmable current source. For instance, voltage regulator 106 can include a positive offset control circuit 126 configured to implement a positive shift of a first voltage level within the voltage regulator 106. In some embodiments, positive offset control circuit 126 can include at least a first resistor and a first programmable current source. Additionally or alternatively, voltage regulator 106 can include a negative offset control circuit 128 configured to implement a negative shift of a second voltage level within the voltage regulator 106. In some embodiments, negative offset control circuit 128 can include at least a second resistor and a second programmable current source.

In accordance with another aspect of the disclosed technology, in some embodiments, output device 134 can include one or more electric circuit elements, integrated circuits, or nodes configured to provide a regulated output voltage to one or more other circuit blocks. For example, output device 134 can include at least a first transistor that is matched to a second transistor within the voltage regulator 106 such that the matching between first and second transistors is configured to provide supply regulation within the voltage regulator 106. As such, supply regulator 130 is implemented in part from matching between a transistor (e.g., the first transistor forming output device 134) and a second transistor elsewhere in the voltage regulator 106. In some examples, the first and second transistors that form supply regulator 130 correspond to field effect transistors, for example n-type MOSFET devices.

Referring still to FIG. 2, in some implementations, voltage regulator 106 can include a positive feedback loop 124. Positive feedback loop 124 can be formed at least in part by current mirror 122, the first transistor forming output device 134 and the second transistor formed to provide matching with the first transistor. In some implementations, voltage regulator 106 includes at least a third transistor and a fourth transistor (e.g., as part of current mirror 122) such that positive feedback loop 124 is formed at least in part by the first transistor, the second transistor, the third transistor, and the fourth transistor. In some implementations, the first transistor and the second transistor comprise n-channel transistors, while the third transistor and the fourth transistor comprise p-channel transistors. In some implementations, each of the first transistor, the second transistor, the third transistor, and the fourth transistor comprise field effect transistors (e.g., MOSFETs). In some implementations, positive feedback loop 124 is characterized by a loop gain that is less than one under all conditions encountered within the voltage regulator 106.

According to another aspect of the present disclosure, voltage regulator 106 can include a current regulator 132. In some implementations, current regulator 132 can include a plurality of transistors (e.g., MOSFETs such as a combination of n-channel transistors and p-channel transistors). In some implementations, current regulator 132 can be configured to guarantee that the current pulled from the source voltage (e.g., a source voltage from voltage source 104 of FIG. 1) is always greater than the current forced into the voltage source by the second transistor.

FIG. 3 includes a first example voltage regulator circuit 200, which can include a combination of circuit elements configured to provide voltage regulation in the form of a source follower circuit. In some implementations, first example voltage regulator circuit 200 of FIG. 3 can form voltage regulator 106 of FIGS. 1-2.

Referring more particularly to FIG. 3, voltage regulator circuit 200 is configured to receive a source voltage 202 (e.g., $V_{DDH}$). Source voltage 202 is coupled to a first current mirror 204 (e.g., Current Mirror 0). First current mirror 204 is a circuit designed to copy a current associated with the source voltage 202 into multiple components while keeping the output current constant regardless of loading. In some implementations, first current mirror 204 can include at least a third transistor and a fourth transistor, for example, p-channel MOSFETS.

First current mirror 204 can be configured to generate a first current 206 (e.g., $I_{MIRROR1}$) from a node 212, a second current 208 (e.g., $I_{MIRROR0}$) from a node 214, and a third current 210 (e.g., $I_{REF0}=I_{LOAD}$) from a node 216. The first current 206 can be represented in relation to the third current 210 divided by a value x (e.g., 'MIRROR'$=I_{LOAD}/x$) while the second current 208 can be represented in relation to the third current 210 divided by a value of 4x (e.g., $I_{MIRROR0}=I_{LOAD}/4x$). The first current 206, second current 208, and third current 210 are variously configured to be coupled to one or more connectors (e.g., drain, source, and/or gate) of a first transistor 218 (e.g., $Mn_0$) and a second transistor 220 (e.g., $Mn_1$). The second transistor 220 can be configured to serve as at least part of an output device for voltage regulator circuit 200.

First current 206 (e.g., $I_{MIRROR1}$) of FIG. 3 can be configured to flow from node 212 to second transistor 220 (e.g., to a drain of second transistor 220). In some implementations, second transistor 220 can be an n-channel MOSFET configured to generate a second gate-source voltage (e.g., $V_{GS1}$). Second transistor 220 (e.g., a source of second transistor 220) can also be coupled to ground via a voltage source 240 and a source resistor 242 (e.g., $R_S$) in parallel with a source capacitor 244 (e.g., $C_S$), and in parallel with an input terminal 246 configured to provide an input voltage 248 (e.g., $V_{IN}$) and an input current 250 (e.g., $I_{IN}$). Second transistor 220 (e.g., a source of second transistor 220) can also be coupled to a second current mirror 251 (e.g., Current Mirror 1). Second current mirror 248 can be associated with a fourth current 252 (e.g., $I_{MIRROR2}$) and a fifth current 254 (e.g., $I_{REF1}$).

Second current 208 (e.g., $I_{MIRROR0}$) of FIG. 3 can be configured to flow from node 214 to first transistor 218 (e.g., to a gate of first transistor 218) and to a second transistor 220 (e.g., to a gate of second transistor 220). Second current 208 can also be configured to flow to one or more offset control circuits within voltage regulator circuit 200. For example, second current 208 can flow to a negative offset control circuit formed by a first resistor 230 (e.g., $R_0$) and a first programmable current source 232 (e.g., $I_M$) and to a positive offset control circuit formed by a second resistor 234 (e.g., $R_1$) and a second programmable current source 236 (e.g., $I_P$). A filter capacitor 238 (e.g., $C_{FILTER}$) can also be coupled to ground from the first transistor 218 (e.g., from a gate of the first transistor 218 to ground).

A third current 210 (e.g., $I_{LOAD}$) can be configured to flow from node 216 to first transistor 218 (e.g., to a drain of a first transistor 218). In some implementations, first transistor 218 can include a field effect transistor such as but not limited to a MOSFET. In some implementations, first transistor 218 can be an n-channel MOSFET configured to generate a first gate-source voltage (e.g., $V_{GS0}$). First transistor 218 (e.g., a source of first transistor 218) can be coupled to ground via a fixed current source 222 (e.g., a 100 μA current source), in parallel with an output terminal 224 configured to provide an output voltage 225 (e.g., $V_{OUT}$), in parallel with a load capacitor 226 (e.g., $C_L$), in parallel with a load resistor 228 (e.g., $R_L$).

Referring still to FIG. 3, voltage regulator circuit 200 can be configured in certain implementations with one or more predetermined relationships and/or conditions among the various circuit elements thereof. For example, in some implementations, it should be appreciated that matching between the first transistor 218 and second transistor 220 can be achieved by ensuring that the first gate-source voltage (e.g., $V_{GS0}$) associated with first transistor 218 is substantially equal to the second gate-source voltage (e.g., $V_{GS1}$) associated with the second transistor 220. In other words, $V_{GS0}=V_{GS1}$. This condition can also be satisfied by ensuring that the current density of the first transistor 218 and the second transistor are substantially equal.

In some implementations, relationships can be established among the various voltages of voltage regulator circuit 200. More particularly, the output voltage ($V_{OUT}$) can be defined as the input voltage ($V_{IN}$) plus the second gate-source voltage ($V_{GS1}$) plus the positive offset voltage ($\Delta V_P$) minus the negative offset voltage ($\Delta V_M$) minus the first gate-source voltage ($V_{GS1}$). In other words, $V_{OUT}=V_{IN}+V_{GS1}+\Delta V_P-\Delta V_M-V_{GS0}$. When we ensure that the matching condition between first transistor 218 and second transistor 220 is satisfied, and $V_{GS0}=V_{GS1}$, then we can rewrite the above relationships as $V_{OUT}=V_{IN}\ \Delta V_P-\Delta V_M$, where $\Delta V_P=R_1 \cdot I_P$ and $\Delta V_M=R_0 \cdot I_M$. Again, the currents $I_P$ and $I_M$ are respectively associated with first programmable current source 232 and second programmable current source 236. When these values are substantially equal to one another (e.g., $I_P=I_M=0$), then the output voltage is substantially equal to the input voltage (e.g., $V_{OUT}=V_{IN}$). To create a small positive or negative voltage difference between $V_{OUT}$ and $V_{IN}$, varied current levels of the first programmable current source 232 and second programmable current source 236 can be utilized.

In some implementations, various relationships and/or conditions associated with one or more currents within voltage regulator circuit 200 can be established. For example, in some implementations, it can be important to ensure that the input current ($I_{IN}$) is always greater than zero (e.g., $I_N>0$) since an LDO generating $V_{IN}$ can only support load current $I_{IN}$ in the positive direction. To achieve this condition, second current mirror 251 can be used where a positive feedback loop is formed at least in part by the first transistor 218, the second transistor 220, and the first current mirror 204 (which can include third and fourth transistors in some implementations). To keep this positive feedback loop gain less than one (1), it can be helpful to ensure that source resistor 242 (e.g., $R_S$) is less than load resistor 228 (e.g., $R_L$) times x (e.g., $R_S<R_L \cdot x$), and that the source capacitor 244 (e.g., $C_S$) is greater than the load capacitor 226 (e.g., $C_L$) divided by x (e.g., $C_S>C_L/x$). When these conditions are met, current relationships associated with voltage regulator circuit 200 can be determined. More particularly, fourth current 252 can be substantially equal to five times the fifth current 254, which can be substantially equal to five times the first current 206, which can be substantially equal to 5/4 times the second current 214. This relationship can be represented by the following equation:

$$I_{MIRROR2} = 5I_{REF1} = 5I_{MIRROR0} = \frac{5}{4} I_{MIRROR1}$$

Further, in some implementations, the input current 250 can be substantially equal to the fourth current 252 minus the first current 206, which can be substantially equal to ¼ of the first current 206. This relationship can be represented by the following equation:

$$I_{IN} = I_{MIRROR2} - I_{MIRROR1} = \frac{1}{4} I_{MIRROR1}$$

Figure 4:
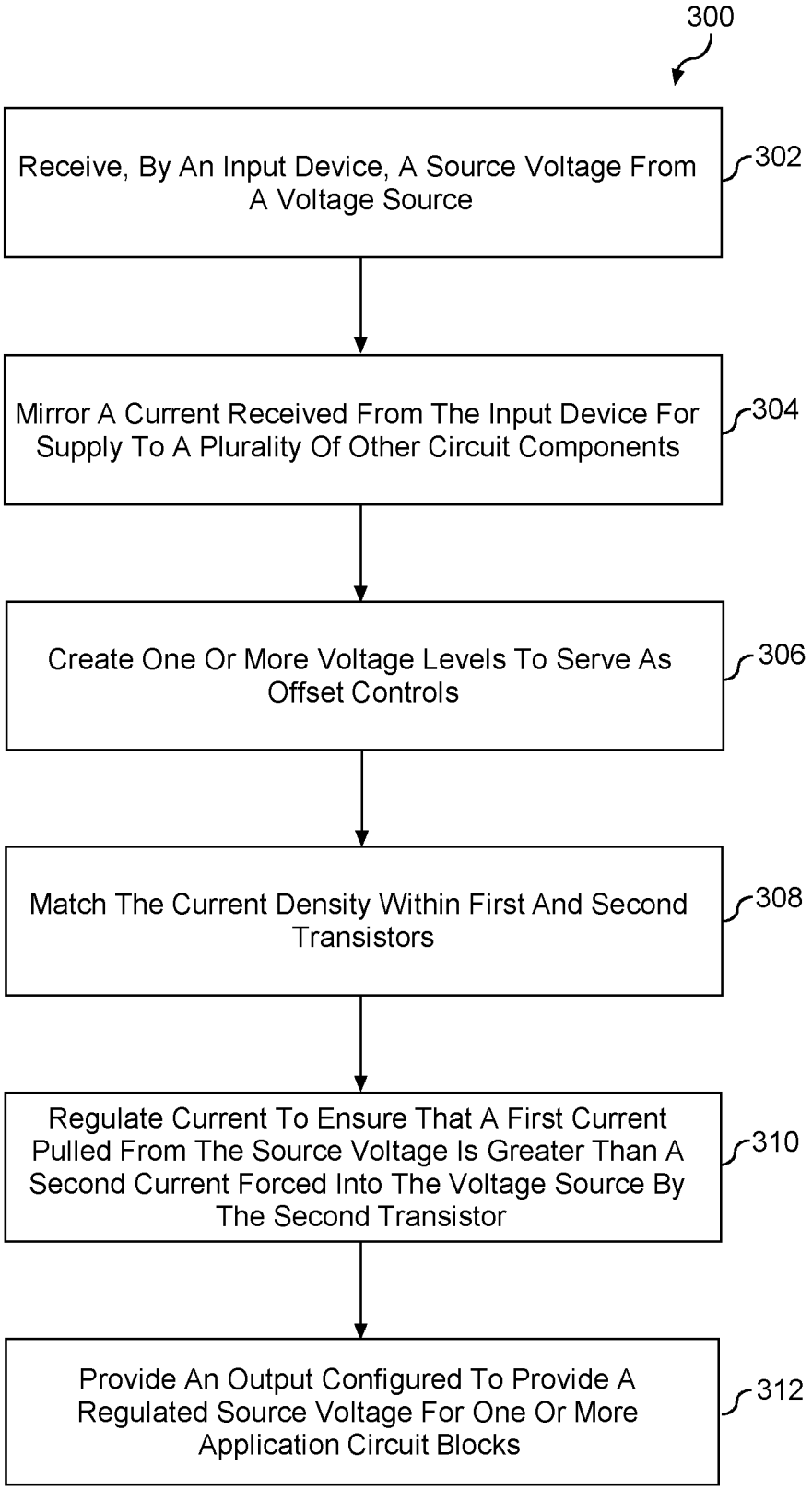
FIG. 4 depicts a flow diagram of an example method according to example embodiments of the present disclosure.

FIG. 4 depicts a flow diagram of an example method 300 according to example embodiments of the present disclosure. FIG. 4 depicts steps performed in a particular order for purposes of illustration and discussion. Those of ordinary skill in the art, using the disclosures provided herein, will understand that various steps of any of the methods described herein can be omitted, expanded, performed simultaneously, rearranged, and/or modified in various ways without deviating from the scope of the present disclosure. In addition, various steps (not illustrated) can be performed without deviating from the scope of the present disclosure. Additionally, the method 300 is generally discussed with reference to the various systems of FIGS. 1-3, including but not limited to voltage regulator 106 and voltage regulator circuit 200 described above. However, it should be understood that aspects of the present method 300 may find application with any suitable integrated circuit system. Moreover, it should be understood that aspects of the present method 300 may find application in any system involving data supply of a source voltage to one or more application circuits.

The method 300 can include, at (302), receiving, by an input device, a source voltage (e.g., $V_{DD}$ as depicted in FIG. 3) from a voltage source. In some implementations, the input device can additionally receive an input voltage (e.g., $V_{IN}$ as depicted in FIG. 3) from another regulator, such as an LDO voltage regulator. In some implementations, the input device configured to receive the source voltage at (302) can include input device 120 such as depicted in FIG. 2.

The method 300 can include, at (304), mirroring the current received from the input device for supply to a plurality of other circuit components. In some examples, mirroring the current received from the input device at (304) includes generating one or more currents (e.g., the first current 206, second current 208, and third current 210 depicted in FIG. 3) In some implementations, mirroring the current received from the input device at (304) can be implemented by a current mirror (e.g., current mirror 122 of FIG. 2 or first current mirror 204 of FIG. 3). In some implementations, such a current mirror configured to mirror the current at (304) can include a combination of one or more transistors (e.g., at least first and second p-channel MOSFETS).

The method 300 can include, at (306), creating one or more voltage levels to serve as offset controls. Such offset controls can introduce intentional mismatch in supply to improve signal detection. More particularly, in some implementations, the one or more voltage levels created at (306) can be generated by one or more offset control circuits configured to balance voltage levels within a voltage regulator circuit. In some embodiments, each offset control circuit can include one or more resistors and at least one programmable current source. For instance, the one or more voltage levels created at (306) can include a relatively small positive voltage and a relatively small negative voltage. In some embodiments, a negative offset control circuit can create a small negative voltage via at least a first resistor and a first programmable current source (e.g., first resistor 230 and first programmable current source 232 of FIG. 3). Additionally or alternatively, a positive offset control circuit can create a small positive voltage via at least a second resistor and a second programmable current source (e.g., second resistor 234 and second programmable current source 236 of FIG. 3).

The method 300 can include, at (308), matching the first and second transistors. In some implementations, matching the first and second transistors at (308) can be achieved by ensuring that a first gate-source voltage (e.g., $V_{GS0}$ depicted in FIG. 3) associated with a first transistor (e.g., first transistor 218 of FIG. 3) is substantially equal to a second gate-source voltage (e.g., $V_{GS1}$ depicted in FIG. 3) associated with a second transistor (e.g., a second transistor 220 of FIG. 3). In other words, $V_{GS0}=V_{GS1}$. Matching the first and second transistors at (308) can also be satisfied by ensuring that the current density of the first transistor and the second transistor are substantially equal.

The method 300 can include, at (310), regulating current to ensure that a first current pulled from the source voltage is always greater than a second current forced into the voltage source by the second transistor. In other words, current regulating at (310) can include ensuring that an input current ($I_{IN}$ such as depicted in FIG. 3) is always greater than zero (e.g., $I_{IN}>0$) since an LDO generating $V_{IN}$ can only support load current $I_{IN}$ in the positive direction. To regulate current in this manner, a positive feedback loop can be formed at least in part by a first transistor (e.g., first transistor 218), a second transistor (e.g., second transistor 220), and a current mirror (e.g., first current mirror 204). To keep this positive feedback loop gain less than one (1), it can be helpful to ensure that a source resistor 242 (e.g., $R_S$) is less than load resistor 228 (e.g., $R_L$) times x (e.g., $R_S<R_L \cdot x$), and that the source capacitor 244 (e.g., $C_S$) is greater than the load capacitor 226 (e.g., $C_L$) divided by x (e.g., $C_S>C_L/x$), such components as depicted in FIG. 3.

The method 300 can include, at (312), providing, by an output device associated with the first transistor, an output configured to provide a regulated source voltage for one or more application circuit blocks. In some implementations, providing an output at (312) via an output device can include providing one or more electric circuit elements, integrated circuits, or nodes configured to provide a regulated output voltage to one or more other circuit blocks. For example, output device 134 of FIG. 2 can include at least a first transistor that is matched to a second transistor within the voltage regulator.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A voltage regulator comprising:

an input device configured to receive a source voltage from a voltage source;

a current mirror coupled to the input device and configured to provide load current regulation within the voltage regulator;

one or more offset control circuits configured to balance voltage levels within the voltage regulator;

an output device including at least a first transistor that is matched to a second transistor within the voltage regulator such that the matching is configured to provide supply regulation within the voltage regulator; and a positive feedback loop formed at least in part by the current mirror, the first transistor and the second transistor;

wherein the one or more offset control circuits comprises a negative offset control circuit configured to implement a negative shift of a first voltage level within the voltage regulator, wherein the negative offset control circuit comprises at least a second resistor and a second programmable current source.

2. The voltage regulator of claim 1, wherein the first transistor and the second transistor each comprise a field effect transistor.

3. The voltage regulator of claim 1, wherein the one or more offset control circuits comprises a positive offset control circuit configured to implement a positive shift of a first voltage level within the voltage regulator, wherein the positive offset control circuit comprises at least a first resistor and a first programmable current source.

4. The voltage regulator of claim 1, wherein:

the voltage regulator comprises at least a third transistor and a fourth transistor; and the positive feedback loop is formed at least in part by the first transistor, the second transistor, the third transistor, and the fourth transistor.

5. The voltage regulator of claim 4, wherein the first transistor and the second transistor comprise n-channel transistors, and wherein the third transistor and the fourth transistor comprise p-channel transistors.

6. The voltage regulator of claim 1, wherein a loop gain is associated with the positive feedback loop, and wherein the loop gain is less than one under all conditions encountered within the voltage regulator.

7. The voltage regulator of claim 1, further comprising a current regulator comprising a plurality of transistors and configured to guarantee that current pulled from the source voltage is always greater than current forced into the voltage source by the second transistor.

8. The voltage regulator of claim 1, wherein the source voltage from the voltage source is supplied via a low drop out voltage regulator.

9. A power supply circuit comprising:

a voltage source configured to supply a source voltage;

a voltage regulator configured to receive the source voltage from the voltage source, wherein the voltage regulator comprises:

a current mirror coupled to an input device and configured to provide load current regulation within the voltage regulator;

one or more offset control circuits configured to balance voltage levels within the voltage regulator;

an output device including at least a first transistor that is matched to a second transistor within the voltage regulator such that the matching is configured to provide supply regulation within the voltage regulator; and a positive feedback loop formed at least in part by the current mirror, the first transistor and the second transistor;

wherein the one or more offset control circuits comprises a negative offset control circuit configured to implement a negative shift of a first voltage level within the voltage regulator, wherein the negative offset control circuit comprises at least a second resistor and a second programmable current source.

10. The power supply circuit of claim 9, wherein the first transistor and the second transistor each comprise a field effect transistor.

11. The power supply circuit of claim 9, wherein the one or more offset control circuits comprises a positive offset control circuit configured to implement a positive shift of a first voltage level within the voltage regulator, wherein the positive offset control circuit comprises at least a first resistor and a first programmable current source.

12. The power supply circuit of claim 9, wherein:

the voltage regulator comprises at least a third transistor and a fourth transistor; and the positive feedback loop is formed at least in part by the first transistor, the second transistor, the third transistor, and the fourth transistor.

13. The power supply circuit of claim 12, wherein the first transistor and the second transistor comprise n-channel transistors, and wherein the third transistor and the fourth transistor comprise p-channel transistors.

14. The power supply circuit of claim 9, wherein a loop gain is associated with the positive feedback loop, and wherein the loop gain is less than one under all conditions encountered within the voltage regulator.

15. The power supply circuit of claim 9, further comprising a current regulator comprising a plurality of transistors and configured to guarantee that a first current pulled from the source voltage is always greater than a second current forced into the voltage source by the second transistor.

16. A method of regulating a source voltage, comprising:

receiving, by an input device, the source voltage from a voltage source;

mirroring a current received from the input device for supply to a plurality of other circuit components;

creating one or more voltage levels to serve as offset controls using an offset control circuit, the offset control circuit comprising a negative offset control circuit configured to implement a negative shift of a first voltage level, wherein the negative offset control circuit comprises at least a second resistor and a second programmable current source;

matching a current density within first and second transistors;

regulating current to ensure that a first current pulled from the source voltage is always greater than a second current forced into the voltage source by the second transistor; and providing, by an output device associated with the first transistor, an output configured to provide a regulated source voltage for one or more application circuit blocks.

17. The method of claim 16, wherein the offset control circuit comprises a positive offset control circuit configured to implement a positive shift of a first voltage level within the voltage regulator, wherein the positive offset control circuit comprises at least a first resistor and a first programmable current source.

* * * * *